US008757416B2

(12) United States Patent
Golota et al.

(10) Patent No.: US 8,757,416 B2
(45) Date of Patent: Jun. 24, 2014

(54) TAMPER EVIDENT CONTAINER

(75) Inventors: George Golota, Glenview, IL (US); Michael Drozek, Palatine, IL (US); James J. Sanfilippo, Barrington Hills, IL (US); Roman Forowycz, Lake Forest, IL (US); John E. Sanfilippo, Barrington Hills, IL (US); Francisco Javier Soria, West Chicago, IL (US)

(73) Assignee: D&W Fine Pack LLC, Elk Grove Village, IL (US)

( * ) Notice: Subject to any disclaimer, the term of this patent is extended or adjusted under 35 U.S.C. 154(b) by 1148 days.

(21) Appl. No.: 12/350,903

(22) Filed: Jan. 8, 2009

(65) Prior Publication Data

US 2009/0173738 A1 Jul. 9, 2009

Related U.S. Application Data

(60) Provisional application No. 61/019,777, filed on Jan. 8, 2008.

(51) Int. Cl.
*B65D 17/42* (2006.01)
*B65D 17/00* (2006.01)

(52) U.S. Cl.
CPC ..... *B65D 17/165* (2013.01); *B65D 17/161* (2013.01); *B65D 2543/00296* (2013.01)
USPC ..... 220/276; 220/266; 220/269; 220/270

(58) Field of Classification Search
USPC ..... 220/276, 270, 315, 265, 266, 359.2, 220/269, 784, 788, 309.2, 835, 799; 215/48
See application file for complete search history.

(56) References Cited

U.S. PATENT DOCUMENTS

| | | | | |
|---|---|---|---|---|
| 4,202,455 | A * | 5/1980 | Faulstich | 215/48 |
| 4,836,407 | A * | 6/1989 | Bruce et al. | 220/276 |
| 4,854,472 | A | 8/1989 | Semersky | |
| 4,893,452 | A * | 1/1990 | Bruce et al. | 53/420 |
| 6,899,245 | B1 | 5/2005 | Nelson | |
| 7,228,979 | B2 * | 6/2007 | Long, Jr. | 215/252 |
| 8,056,750 | B2 * | 11/2011 | Vovan | 220/270 |
| 8,127,961 | B2 * | 3/2012 | Vovan | 220/270 |

(Continued)

FOREIGN PATENT DOCUMENTS

| | | | |
|---|---|---|---|
| EP | 1559656 | A1 | 3/2005 |
| JP | 11312904 | A | 11/1999 |
| WO | WO9802362 | A3 | 1/1998 |

*Primary Examiner* — Robert J Hicks
*Assistant Examiner* — Kareen Rush
(74) *Attorney, Agent, or Firm* — Cardinal Law Group, LLC

(57) ABSTRACT

A tamper evident container includes a storage element having a flange extending outwardly from a top edge, and a lid having top and outer walls configured to fit over the flange of the storage element with the outer wall extending below a bottom edge of the flange. The outer wall may include an inwardly extending locking indentation engaging the bottom edge of the flange of the storage element to retain the lid on the storage element and prevent it from being removed without permanently deforming at least one of the lid and the storage element, The lid further includes a line of reduced strength extending along a portion of the top wall and/or outer wall to detach a portion of the outer wall and disengage the locking indentation from the flange to allow the lid to be disengaged from the flange without further permanent deformation of the lid or the storage element.

36 Claims, 11 Drawing Sheets

(56) References Cited

U.S. PATENT DOCUMENTS

| | | | | |
|---|---|---|---|---|
| 8,157,123 | B2 * | 4/2012 | Tucker et al. | 220/789 |
| 8,254,242 | B2 * | 8/2012 | Morelli et al. | 370/203 |
| 2003/0189047 | A1 | 10/2003 | McHutchinson | |
| 2004/0020929 | A1 | 2/2004 | Morris | |
| 2006/0006178 | A1 | 1/2006 | Foldesi et al. | |
| 2006/0060578 | A1 | 3/2006 | Church et al. | |
| 2007/0045317 | A1 | 3/2007 | Rosender et al. | |
| 2007/0138180 | A1 | 6/2007 | Vovan | |
| 2008/0302798 | A1 * | 12/2008 | Foldesi, Sr. | 220/276 |
| 2010/0051620 | A1 * | 3/2010 | Parikh et al. | 220/270 |
| 2010/0108680 | A1 * | 5/2010 | Vovan et al. | 220/270 |

* cited by examiner

TAMPER EVIDENT CONTAINER

CROSS REFERENCE TO RELATED APPLICATION

This application claims the benefit of Provisional Patent Application No. 61/019,777, filed Jan. 8, 2008, the disclosure of which is incorporated herein by reference in its entirety.

TECHNICAL FIELD

The present disclosure is directed to a container for transporting and storing packaged products and, in particular, to a tamper evident container having a release mechanism providing visual evidence that the container has been opened and allowing the container to be reclosed to retain a quantity of a product disposed therein.

BACKGROUND OF THE DISCLOSURE

Resealable plastic containers in various forms are known in the art. Such containers are particularly useful for storing and transporting perishable items such as perishable foods, and other items being packaged on a small scale and/or close to the point of sale at a grocery store, convenience store and the like. The containers may have a two-piece construction with a bottom bowl, tray, tub or other storage element and a top lid, or may have a one-piece construction with a hinge connecting the lid to the storage element. These types of containers are typically made by thermoforming or blow molding plastics, such as polyesters, polyethylene terephthalate (PETE), polylactic acid (PLA), polyvinyl chloride (PVC), polystyrene (PS), polypropylene (PP) and the like.

Because these packages or containers typically contain consumable products, including perishable foods and possibly medications, attempts have been made to provide a tamper-proof construction, or at least a tamper evident lid so that retail employees and consumers can detect when a container has been opened or has been otherwise tampered. It is preferable to provide such a construction without the necessity of using complex molding techniques. In one common type of tamper evident container, shrink wrap is applied around the lid and mouth of the storage element to secure the lid in place. The shrink wrap must be broken before the lid can be removed, thereby providing evidence that the container has been opened. This type of tamper evident container requires the use of an additional shrink wrapping machine and shrink wrapping step to complete the sealing of the container. This may be particularly problematic or time consuming where the food to be packaged in the container is prepared on site and packaged at the retailer. The opening of the package may also be more difficult when the consumer attempts to remove the shrink wrap, and may require the use of a tool such as a scissors or a knife. Consequently, the packaging process may be more labor and equipment intensive, opening the package may be more inconvenient for the consumers, and the additional shrink wrap material may increase the cost of the package.

In another common type of tamper evident container, both the lid and the storage element are modified to provide a locking mechanism that secures the lid to the storage element such that the lid can only be removed by breaking the locking mechanism and thereby providing a visual indication that the container has been opened. For example, U.S. Publ. No. 2007/0138180 to Vovan discloses a container including a base that can hold food and a lid that closes on the base that clearly indicates if the lid has been opened after a clerk loaded food into the base and closed the lid. The base and lid each have trapping portions and pull-open portions with a tear-tab, or tear-open barrier. To close the lid, a clerk projects a tab on the pull-open portion of the lid through a slot in the pull-open portion of the base, and then presses down the entire trapping portion of the lid into the trapping portion of the base. The lid cannot be lifted up because the tear-open barrier forming the top wall of the slot lies over the tab. To open the container, a person must tear the barrier so he/she can pull up the tab and open the lid. The torn barrier provides visual evidence that the container has been opened. In these types of containers, both the lid and the storage element, and the corresponding dies or molds forming these components or other tooling, must be modified to form the locking mechanism, further adding to the cost of producing the containers.

It would, therefore, be desirable to provide a container that overcomes these and other disadvantages.

SUMMARY OF THE INVENTION

In accordance with an embodiment of the invention, a tamper evident container for storing a quantity of a product may include a storage element that may have a top edge defining an opening of the storage element and a flange extending outwardly therefrom, and a lid that may have a complimentary shape to the opening of the storage element and a top wall and an outer wall configured to fit over the flange of the storage element with the outer wall extending below a bottom edge of the flange. The outer wall may include at least one inwardly extending locking indentation engaging the bottom edge of the flange of the storage element when the lid is disposed on the storage element to retain the lid on the storage element such that the lid cannot be removed from the storage element without permanently deforming at least one of the lid and the storage element. The lid may further include a line of reduced strength extending along a portion of at least one of the top wall and the outer wall to detach a portion of the outer wall and disengage the corresponding portion of the at least one locking indentation from the flange to allow the lid to be disengaged from the flange without further permanent deformation of the lid or the storage element.

In accordance with another embodiment of the invention, a lid for a container for storing a quantity of a product and having a storage element having a top edge defining an opening of the storage element and a flange extending outwardly therefrom, the lid may include a base wall having a complimentary shape to the opening of the storage element and an outer wall extending downwardly from the base wall. The base wall and the outer wall may be configured to fit over the flange of the storage element with the outer wall extending below a bottom edge of the flange. The outer wall may include at least one inwardly extending locking indentation that may engage the bottom edge of the flange of the storage element when the lid is disposed on the storage element to retain the lid on the storage element such that the lid cannot be removed from the storage element without permanently deforming at least one of the lid and the storage element. The lid may further include a line of reduced strength extending along a portion of at least one of the base wall and the outer wall to detach a portion of the outer wall and disengage the corresponding portion of the at least one locking indentation from the flange to allow the lid to be disengaged from the flange without further permanent deformation of the lid or the storage element.

In accordance with yet another embodiment of the invention, a lid for storing a quantity of a product and having a storage element having a top edge defining an opening of the storage element and a flange extending outwardly therefrom, the lid may include a base wall, a side wall extending upwardly from the base wall and having a top edge with a complimentary shape to the opening of the storage element, a top wall extending downwardly from the side wall at the top edge, and an outer wall, wherein the side wall, the top wall and the outer wall may be configured to fit over the flange of the storage element with the outer wall extending below a bottom edge of the flange. The outer wall may include at least one inwardly extending locking indentation engaging the bottom edge of the flange of the storage element when the lid is disposed on the storage element to retain the lid on the storage element such that the lid cannot be removed from the storage element without permanently deforming at least one of the lid and the storage element. The lid may further include a pull tab disposed adjacent a corner of the outer wall and outwardly extending from the outer wall, and two lines of reduced strength each extending along a portion of at least one of the top wall and the outer wall to detach the corner of the outer wall and disengage the corresponding portion of the at least one locking indentation from the flange to allow the lid to be disengaged from the flange without further permanent deformation of the lid or the storage element.

Figure 1:
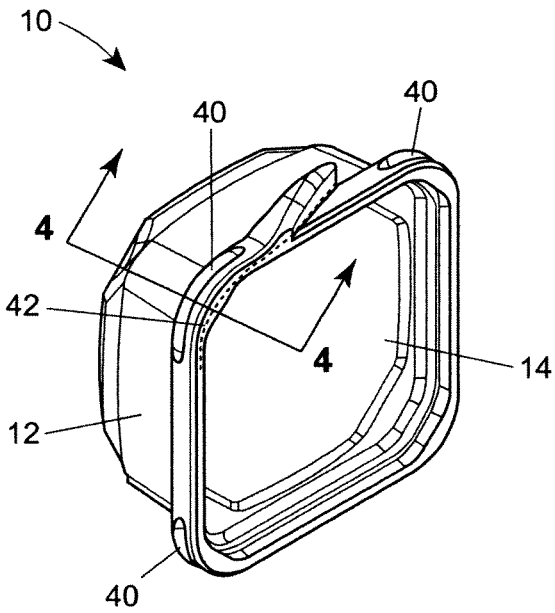
FIG. 1 is a perspective view of a tamper evident container in accordance with the present disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

In order to provide a container capable of storing a product therein and providing visual evidence of the opening or attempted opening of the container, a bowl, tray, tub or other storage element and a corresponding lid have complimentary configurations that require permanent deformation or destruction of one or both components for removal of the lid once the lid is attached to the top of the storage element. The storage element may include an outwardly extending flange at a top edge of the storage element, and the lid may include outwardly and downwardly extending walls that wrap around the flange of the storage element with locking portions, such as locking nipples, tabs, tags, nubs, protrusions, or indentations, having negative angles undercutting the flange to secure the lid to the storage element. The lid further includes a line of reduced strength formed by a series of punctures, score lines or the like along a portion of the outwardly and/or downwardly extending walls that yields to detach a portion of the lid undercutting the flange of the bowl to allow removal of the lid from the bowl. The lid may further include a pull tab extending outwardly and having the line of reduced strength extending between the pull tab and a wall of the lid such that the pull tab may be grasped and pulled away from the lid to break the lid along the line of reduced strength and detach the portion undercutting the flange.

FIG. 1 illustrates an embodiment of a tamper evident container 10 in accordance with the present disclosure. The container 10 includes a bowl, tray, or tub or other storage element 12 and a lid 14 configured to attach to the storage element 12 in a manner that prevents detachment of the lid 14 without a visual indication of the removal of the lid 14, such as permanent deformation of the storage element 12 and/or the lid 14, or the destruction of one or both of the components. Referring to FIG. 2, the storage element 12 may be generally concave-shaped and include a bottom wall 16 and one or more side walls 18. In the illustrated embodiment, the storage element 12 is generally square or rectangular with four side walls 18. However, the storage element 12 may have other geometric configurations as necessary for the product to be stored therein and to have a desired appearance. For example, the storage element 12 may be substantially circular or oval and have a single continuous side wall 18, or include a flat portion for use in sortation of the containers or standing the containers on end for packaging or display, with the lid 14 having a corresponding shape.

The side walls 18 extend upwardly from the bottom wall 16 and terminate at an open top edge 20. The side walls 18 may include an inwardly extending ridge 19 disposed near the open top edge 20. The inwardly extending ridge 19 may engage a corresponding inner slot on the lid 14 to retain the lid 14 on the storage element 12. The inwardly extending ridge 19 may extend substantially continuously along the side walls 18 of the storage element 12. A radial flange 22 extends outwardly at the top edge 20 of the side walls 18 and extends beyond the side walls 18. The flange 22 may include a radially extending portion 24 and a downwardly extending annular portion 26 that are best illustrated in the detail view of the corner of the container 10 at FIG. 2C. The components of the storage element 12 may have a desired thickness in the range of 0.007"-0.070", or may have varying thicknesses as necessary to contain the product disposed therein and as dictated by the characteristics from which the storage element 12 if formed, by the package size, and by other factors. Moreover, the flange 22 may be thicker and extend radially without having separate portions 24 and 26. The sidewalls 18 may further include one or more gussets or ribs to improve stability and rigidity of the storage element 12. The gussets may be formed as is known in the art. For example, one or more gussets can be formed inwardly extending from the side wall and extending vertically along the side wall.

Figure 2A:
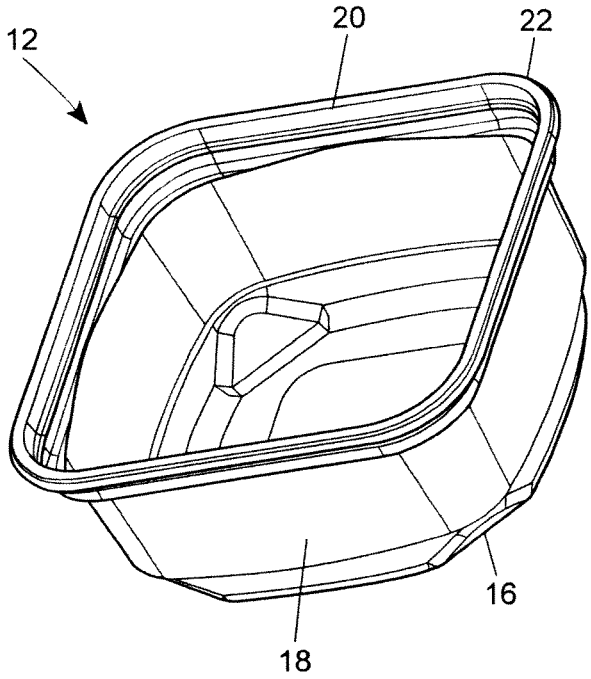
FIGS. 2A-2C are perspective, side, and detail views, respectively, of a bowl, tray or tub of the tamper evident container of FIG. 1.
Figure 2B:
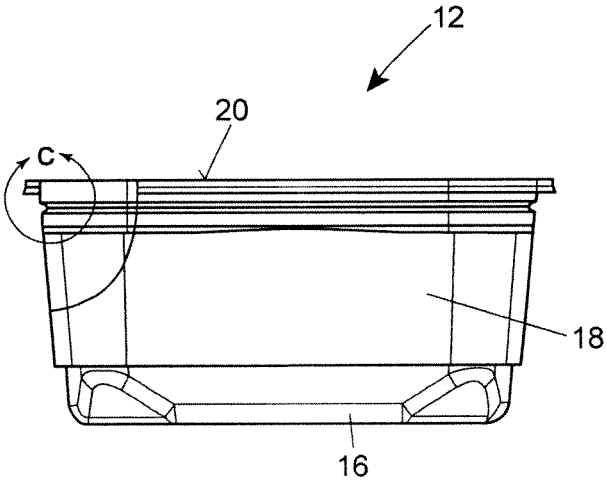
Figure 2C:
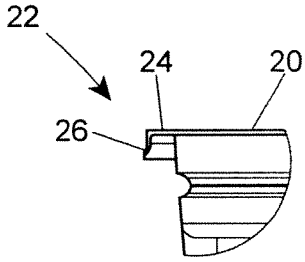

It should be noted that the dimensions and geometry of the storage element 12 shown in FIGS. 2A-2C are exemplary only, and the particular dimensions and configuration of the storage element 12 may be dictated by the requirements of a particular implementation of the tamper evident container 10. Additionally, it is contemplated that the same lid 14 may be attached to storage elements 12 of varying sizes and storage capacities, but with similar sized openings at their top edges 20. Moreover, as discussed above, the storage element 12 and, consequently, the container 10 and lid 14, may have shapes other than the generally square or rectangular shape with one or more curved sides, as shown. The container 10 may have a circular or oval opening, or have other desired shape, and may be implemented with a tamper evident lid 14 as discussed below, and such shapes are contemplated by the inventors as having use in containers in accordance with the present disclosure.

Figure 3A:
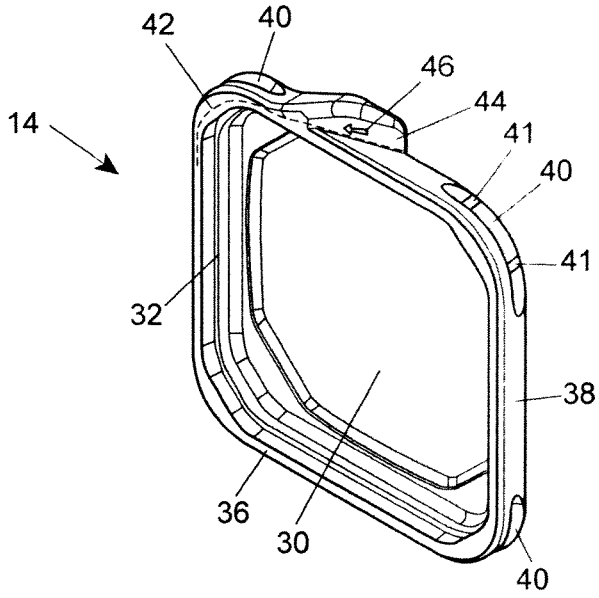
FIGS. 3A-3C are perspective, top, and side views, respectively, of a lid of the tamper evident container of FIG. 1.
Figure 3B:
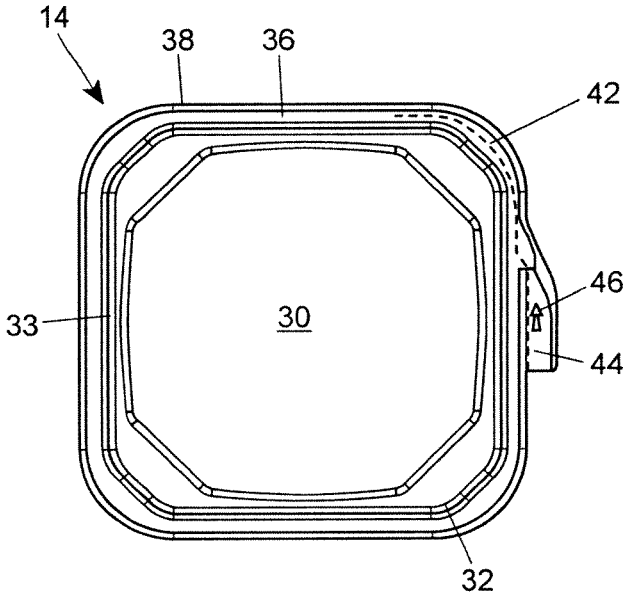
Figure 3C:
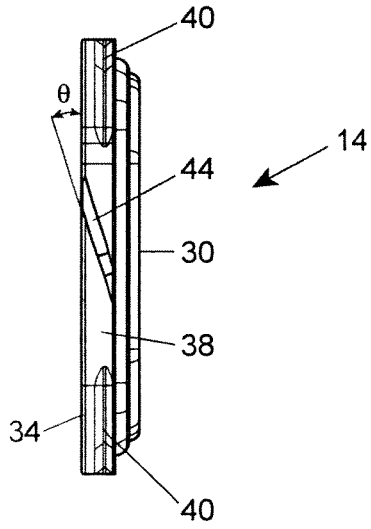

One embodiment of a tamper evident lid 14 configured to attach at the top edge 20 of the storage element 12 is illustrated in FIGS. 3A-3C. As with the dimensions for the storage element 12, the dimensions shown for the lid 14 are exemplary only, and the lid 14 may be configured and dimensioned as appropriate for a given implementation of the tamper evident container 10. The lid 14 may include a generally flat or slightly concave base wall or surface 30 and an upwardly extending inner wall or walls 32 terminating at an upper edge 34. The inner walls 32 are configured with a complimentary shape to the side walls 18 of the storage element 12. As discussed above, an inner slot 33 can be disposed along the inner wall 32. The inner slot 33 may correspond to and tightly engage the inwardly extending ridge 19 of the storage element 12 to provide an additional locking mechanism and retain the lid 14 on the storage element 12. When the lid 14 is attached to the storage element 12, the ridge 19 may deflect outwardly and/or the slot 33 may deflect inwardly to allow the ridge 19 to be received in and engage the slot 33. Once the ridge 19 is received in the slot 33, the resiliency of the material (s) from which the storage element 12 and the lid 14 are fabricated allow the components to return their normal geometries to lock the lid 14 onto the storage element 12. The tight engagement between the inner slot 33 and ridge 19 may increase the rigidity of the container 10 when the lid 14 is retained on the storage element 14, thereby securing the lid 14 on the storage element 12 against attempts to open the container in a manner that is not evident to an observer. Additionally, the other adjacent surfaces of the lid 14 and the storage element 12 may tightly engage one another, such as the facing surfaces of the side wall 18 and the inner wall 32, and the adjacent surfaces of the outer wall 38 and the outer edge of the flange 22. The tight engagement may enhance the locking of the lid on the storage element 12 and increase the rigidity of the container 10. At the upper edge 34, the lid 14 includes an outwardly extending top wall 36 and a downwardly extending outer wall or walls 38. The walls 32, 36, 38 are configured to fit over the flange 22 of the storage element 12. The illustrated lid 14 having the concave base surface 30 may have particular application where the containers 10 will be stacked on top of each other. For other applications, the base surface 30 may be substantially flat, and may even be concurrent with the top wall 36 such that the lid 14 is flat with the exception of the downwardly extending outer wall 38, and with the inner wall 32 being omitted. Other configurations of the base surface 30 of the lid 14 are also contemplated by the inventors as having use in containers 10 in accordance with the present invention.

Figure 4:
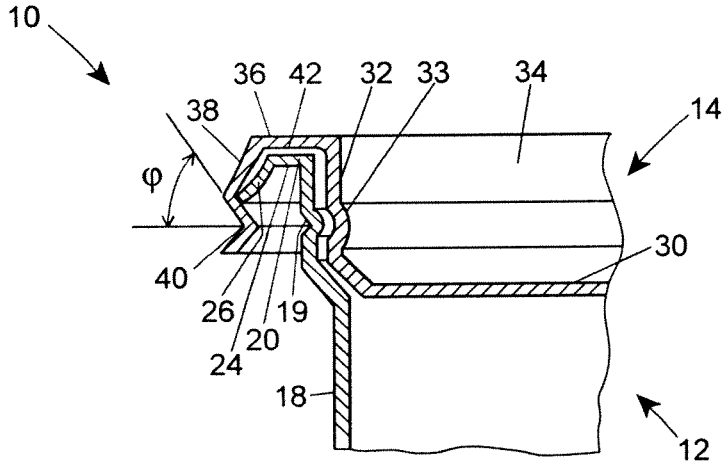
FIG. 4 is a cross-sectional view through line 4-4 of FIG. 1 showing the attachment of the lid of the tamper evident container at a corner of the bowl, tray or tub.

In the illustrated example of the generally square or rectangular storage element 12, the lid 14 is secured to the storage element 12 at the rounded corners of the flange 22 by providing inwardly protruding locking indentations 40 at each corner. In certain embodiments, the corners of the flange 22 may be squared off with the lid 14 being shaped accordingly. The indentations 40 extend inwardly at a negative angle $\phi$ so that the indentations 40 wrap inwardly underneath the annular portion 26 of the flange 22 as shown in FIG. 4. In the present example, the negative angle $\phi$ may be approximately 45°, but other angles may be used as appropriate to ensure that the lid 14 properly engages the flange 22 of the storage element 12. As shown in FIG. 3A, one or more gussets 41 may be provided in the indentation 40 to enhance the strength and rigidity of the corner if desired. When the lid 14 is attached to the storage element 12, the indentations 40 and the outer wall 38 may deflect outwardly and/or the annular portion 26 of the flange 22 may deflect inwardly to allow the indentations 40 to pass over the flange 22. Once the indentations 40 pass the annular portion 26, the resiliency of the material(s) from which the storage element 12 and the lid 14 are fabricated allow the components to return their normal geometries to lock the lid 14 onto the storage element 12.

Figure 5:
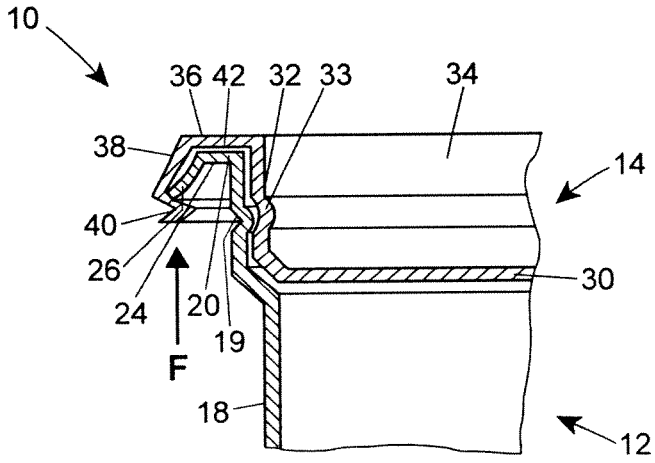
FIG. 5 is the cross-sectional view of FIG. 4 with a force applied to attempt to disengage the lid from the bowl, tray or tub.

Once the lid 14 is secured to the storage element 12 with the indentations 40 engaging the flange 22 at the corners, the lid 14 cannot be removed from the storage element 12 in a manner that is not evident to an observer. If a person attempts to lift the lid 14 over one of the corners, the indentation 40 collapses under the flange 22 as a force F is applied as shown in FIG. 5 to further secure the lid 14 to the storage element 12.

The lid 14 will only detach from the corner if the lid 14 and/or the flange 22 deform plastically and/or break in a manner that is visually evident. Similar visual indications of tampering with the container 10 will also be present if a person pulls on the lid 14 between the corners or presses the side walls 18 and the flange 22 of the storage element 12 inwardly.

In order to allow the lid 14 to be removed in a manner that allows the container 10 to be reclosed, the lid 14 is configured so that one of the corners may be partially detached from the upper edge 34 and the corresponding corner indentation 40 to disengage from the flange 22 of the storage element 12. Detachment of one corner is sufficient to allow the remaining indentations 40 of the lid 14 to disengage from the flange 22 and also to reengage the flange 22 to temporarily reattach the lid 14 and reclose the container 10 if desired. Referring to FIGS. 3A and 3B, the lid 14 may include a line of reduced strength 42, such as a line of punctures, score lines, or a continuous line of reduced thickness. The line of punctures, for example, may be formed by a series of full or partial punctures extending around a portion of the top wall 36 of the lid 14 at one of the corners. The punctures may be formed in the lid 14 at the time the lid 14 is thermoformed, blow-molded or otherwise fabricated by appropriately configuring the die or mold, or may be formed after the lid 14 is fabricated by any appropriate mechanism, such as a stamper or a serrated wheel. In the illustrated embodiment, the punctures have 100% penetration through the top wall 36, and the lid 14 may have a thickness in the range of 0.007" to 0.070" to allow separation along the line of reduced strength 42 without additional deformation or destruction of the lid 14. In certain applications, the lid 14 may have a thickness in the range of 0.010" to 0.040", and in some embodiments, the desired thickness may be in the range of 0.013" to 0.015". However, the line of reduced strength 42 may be formed with less than full penetration if the spacing and size of the punctures are adjusted accordingly to provide detachment of the corner without permanent deformation or destruction of other portions of the lid 14. The line of reduced strength 42 may also be formed as a series of score lines by blade scoring the lid 14. Blade scoring can be performed with partial penetration, such as in the range of 60% to 80% penetration, or with full penetration through the top wall 36 of the lid 14. For example, a continuous blade score with full penetration through the lid 14 may be performed with intermittent interruptions or bridges in the score line being provided to hold the corner in place until the user detaches the corner to open the container 10. The bridges can be formed with partial penetration or no penetration through the top wall 36 of the lid 14. Accordingly, the line of reduced strength 42 can be formed to include punctures that partially penetrate the top wall 36 and bridges that do not penetrate the top wall 36, punctures that fully penetrate the top wall 36 and bridges that do not penetrate the top wall 36, punctures that partially penetrate the top wall 36 and bridges that partially penetrate the top wall 36, and/or punctures that fully penetrate the top wall 36 and bridges that partially penetrate the top wall 36. The distance between the bridges may range from about 0.05 inches to about 2.0 inches and the length of the bridge may fall within the range of about 0.002 inches to about 0.090 inches. Those skilled in the art will understand that other mechanisms for providing the line of reduced strength 42, such as mechanical or laser scoring, or configuring the dies or molds to form the line of reduced strength 42 in the walls 36, 38 of the lid 14 that will separate to detach the outer wall 38, may be used to define the detachable portion of the lid 14 and are contemplated by the inventors as having use in tamper evident containers 10 in accordance with the present disclosure.

To facilitate detachment of the corner of the lid 14 along the line of reduced strength 42, the lid 14 may include a pull tab 44 attached to a portion of the outer wall 38 of the lid 14 proximate the corner having the line of reduced strength 42. For example, the pull tab 44 may be an outward extension of the top wall 36, or may be angled downwardly from the top wall 36 along the outer wall 38 such that the end of the tab 44 is concurrent with a bottom edge of the outer wall 38. In the embodiment illustrated in FIG. 3B, the pull tab 44 slopes downwardly at an angle θ in the range of 5° to 30°, such as at the illustrated angle θ having an approximate value of 17.5°. However, other angles may be used. The pull tab can also have other geometries, such as, for example, a non-planar or curved surface.

Figure 6A:
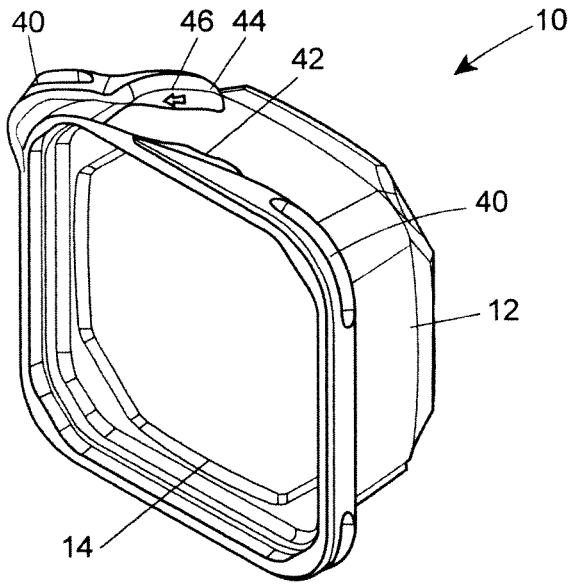
FIGS. 6A and 6B are perspective and top views, respectively, of the tamper evident container of FIG. 1 with the pull tab and corner of the lid detached along the line of reduced strength.
Figure 6B:
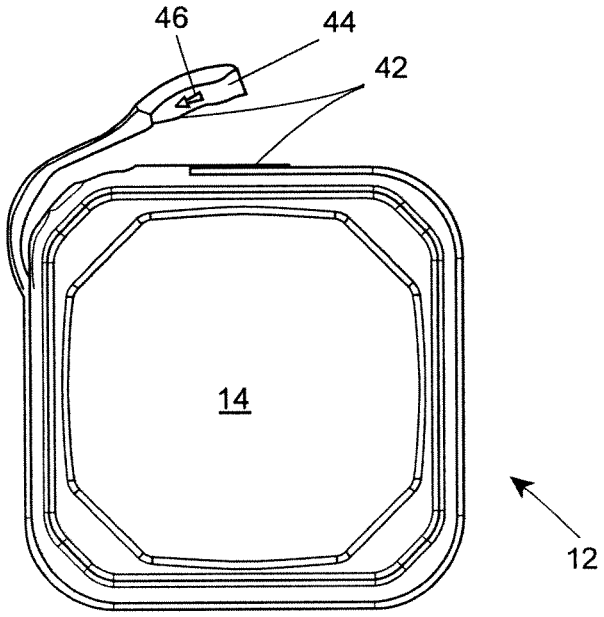

The line of reduced strength 42 may extend from the corner of the lid 14 along the pull tab 44 proximate the point of intersection of the pull tab 44 with the outer wall 38. To further assist the user in opening the container 10, the pull tab 44 may include an arrow 46 formed thereon, or applied after the lid 14 is formed, and pointing in the direction that the pull tab 44 is to be pulled to detach the pull tab 44 and the corner along the line of reduced strength 42. When the user grasps and pulls the pull tab 44 in the direction of the arrow 46 or outwardly from the container 10, the punctures, score lines, or the like cause the pull tab 44 to detach at the end of the pull tab 44 and then along the line of reduced strength 42 around the corner of the lid 14. As the corner detaches at the end of the line of reduced strength 42 and the pull tab 44 is pulled further away from the lid 14, the top wall 36 proximate the end of the line of reduced strength 42 may plastically deform or detach such that the corner and pull tab 44 remain disposed away from the side of the container 10 to provide visual evidence of the opening of the container 10 as shown in FIGS. 6A and 6B. With one of the corners detached, the adjacent corners may be pulled outwardly away from the flange 22 and lifted over the flange 22 to remove the lid 14 from the storage element 12.

Figure 7A:
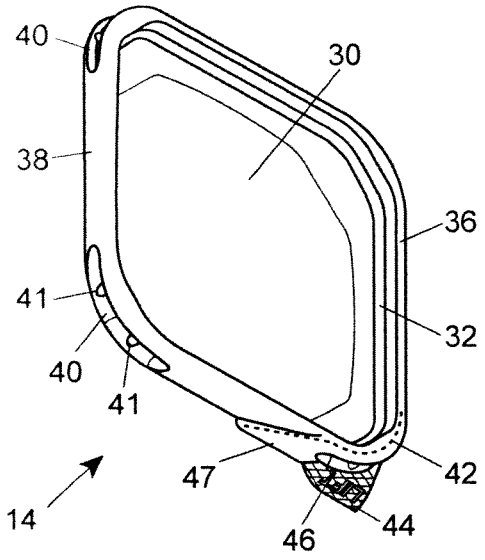
FIGS. 7A and 7B are perspective and top views, respectively, of the lid of the tamper evident container of FIG. 1 with an angled portion and a pull tab disposed adjacent the corner of the lid.
Figure 7B:
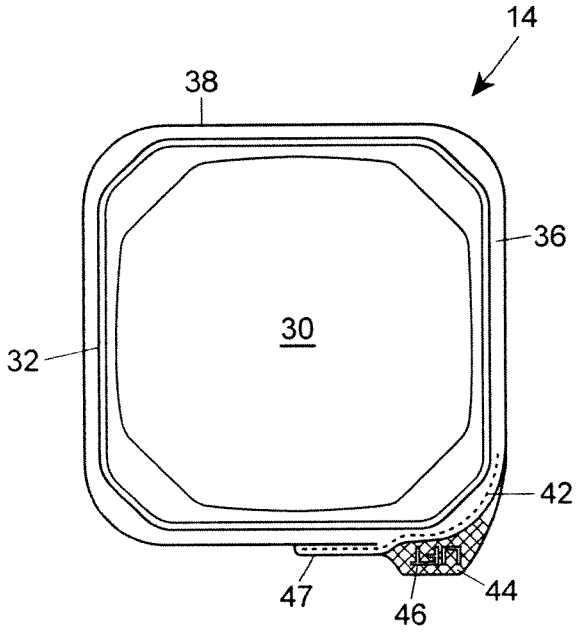

Referring to FIGS. 7A and 7B, much like the embodiment described above with reference to FIG. 3, the embodiment illustrated in FIGS. 7A and 7B includes a pull tab 44 to facilitate detachment of the corner of the lid 14 along the line of reduced strength 42. The pull tab 44 may be an outward extension of the outer wall 38, disposed at the corner having the line of reduced strength 42 and concurrent with a bottom edge of the outer wall 38. An angled portion 47 may be disposed along the outer wall 38 to facilitate detachment of the corner of the lid 14 using the pull tab 44. The angled portion 47 may slope downwardly from the top wall 36 along the outer wall 38 such that the end of the angled portion 47 is concurrent with the bottom edge of the outer wall 38 and the pull tab 44. For example, the angled portion 47 may be sloped downwardly at an angle in a range of 10° to 30°. The line of reduced strength 42 may extend from the corner of the lid 14 along the angled portion 47 proximate the point of intersection of the angled portion 47 with the outer wall 38.

The pull tab 44 can include indicia to assist the user in detaching the corner, such as for example, the word "lift" to indicate that the pull tab 44 is to be lifted to detach the pull tab 44 and the corner along the line of reduced strength 42. The pull tab 44 may also include a gripping pattern formed on the pull tab 44 to further aid the user in gripping and detaching the pull tab 44. When the user grasps and pulls the pull tab 44 upwardly and outwardly from the container 10, the line of reduce strength 42 cause the angled portion 47 to detach along the line of reduced strength 42 around the corner of the lid 14. As the corner detaches at the end of the line of reduced strength 42 and the pull tab 44 is pulled further away from the lid 14, the top wall 36 proximate the end of the line of reduced strength 42 may plastically deform or detach such that the corner and pull tab 44 remain disposed away from the side of the container 10 to provide visual evidence of the opening of the container 10. With one of the corners detached, the adjacent corners may be pulled outwardly away from the flange 22 and lifted over the flange 22 to remove the lid 14 from the storage element 12.

Figure 8A:
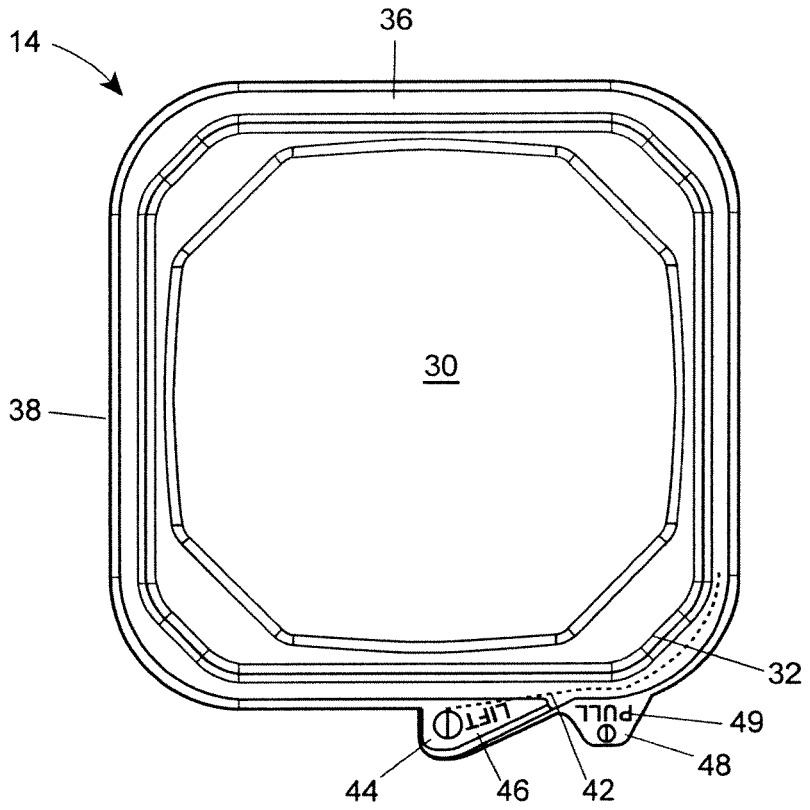
FIGS. 8A and 8B are top and side views, respectively, of the lid of the tamper evident container of FIG. 1 with a gripping tab.
Figure 8B:
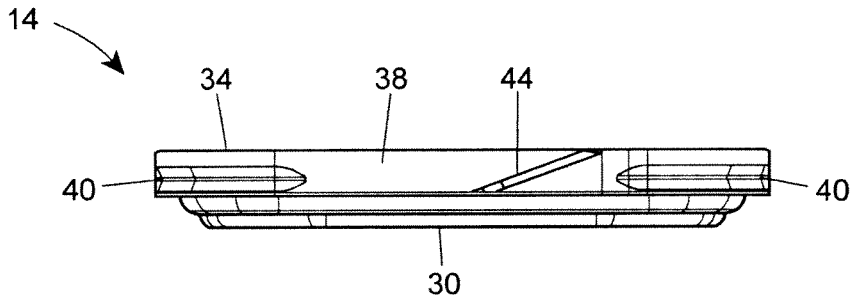

Referring to FIGS. 8A and 8B, the lid 14 can further include a gripping tab 48 attached to a portion of the outer wall 38 of the lid 14. The gripping tab 48 can be an outward extension of a bottom edge of the outer wall 38 of the lid 14. The gripping tab 48 can facilitate detachment of the corner of the lid 14 by providing the user with a secondary surface to grasp while detaching the corner using the pull tab 44. The gripping tab 48 can be provided along any portion of the outer wall 38 of the lid 14. For example, the gripping tab 48 can be provided proximate the pull tab 44. To further assist the user in opening the container 10, the gripping tab 48 may include the number "2" or other indicia 49 formed thereon, or applied after the lid 14 is formed, indicating to the user that the tab is a gripping tab 48 to be held during opening of the container 10. The pull tab 44 may include a number "1" or other indicia 46 formed thereon, or applied after the lid 14 is formed, indicating to the user that the tab is the pull tab 44. The gripping tab 48 may also include a gripping pattern formed on the pull tab 44 to further aid the user in gripping and holding the gripping tab 48 when detaching the pull tab 44.

Figure 9A:
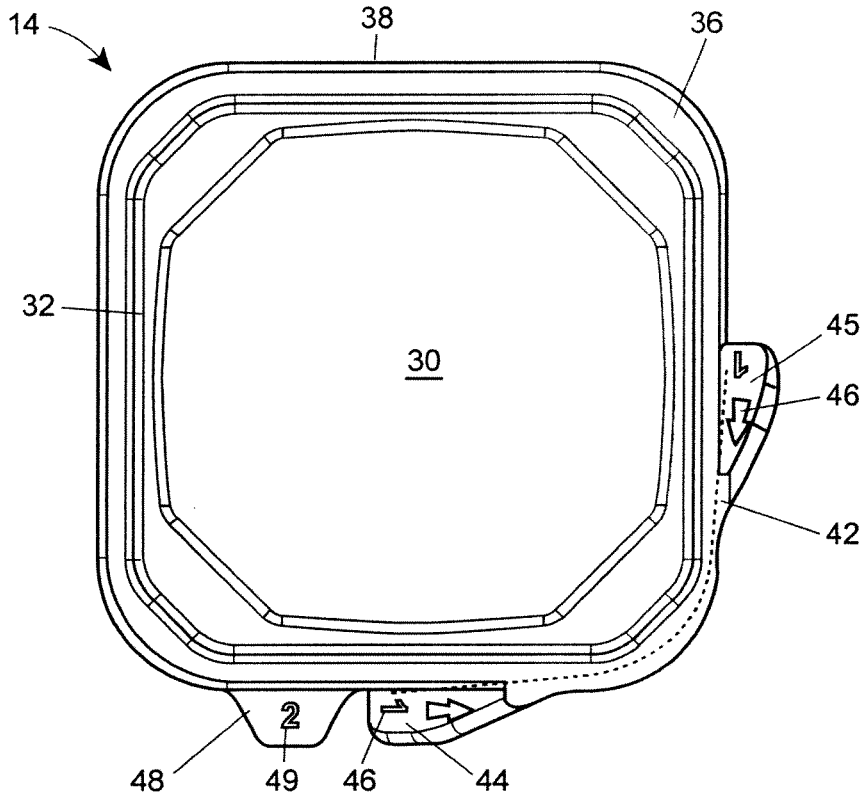
FIGS. 9A and 9B are top and side views, respectively of the lid of the tamper evident container of FIG. 1 with first and second pull tabs and a gripping tab disposed adjacent one of the pull tabs.
Figure 9B:
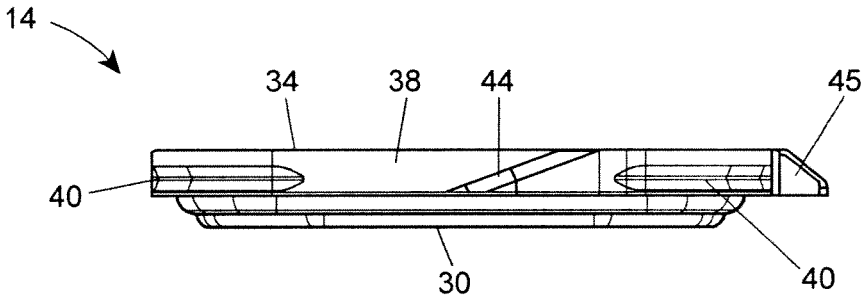

FIGS. 9A and 9B illustrates a further alternative embodiment of the lid 14 wherein a second pull tab 45 may be provided that outwardly extends from the outer wall 38, such that first and second pull tabs 44, 45 are disposed on opposite sides of the corner having the line of reduced strength 42 at either end of the line 42. As described above with reference to FIG. 3, the second pull tab 45 may be an outward extension of the top wall 36, or may be angled downwardly from the top wall 36 along the outer wall 38. The lid 14 can be configured so that one of the corners may be partially or fully detached from the upper edge 34 and the corresponding corner indentation 40 disengaged from the flange 22 of the storage element 12 using either the first or second pull tab 44, 45.

A line of reduced strength 42 may extend from the corner of the lid 14 along the each of the first and second pull tabs 44, 45 proximate the point of intersection of the pull tabs 44, 45 with the outer wall 38. To further assist the user in opening the container 10, the pull tabs 44, 45 may include arrows 46 formed thereon, or applied after the lid 14 is formed, and pointing in the direction that the pull tabs 44, 45 are to be pulled to detach the pull tabs 44, 45 and the corner along the line of reduced strength 42. The pull tabs 44, 46 may also include a gripping pattern formed on the pull tabs 44, 45 to further aid the user in gripping and detaching the pull tabs 44, 45. Either pull tab 44, 45 can be grasped by the user and pulled to partially or fully detach the pull tab 44 and the corner along the line of reduced strength 42. To partially detach the corner, the user may pull either the first or second pull tab 44, 45 until the pull tab 44, 45 and the corner detach along the line of reduced strength 42, but before the remaining pull tab 44, 45 detaches. To fully detach the corner, the user may pull the first or second pull tab 44, 45, until first or second pull tab 44, 45 detaches along the line of reduced strength 42 around the corner of the lid 14, and continue to pull the first or second pull tab 44, 45 to detach the remaining pull tab 44, 45 along the line of reduced strength 42. The user can also pull both the first and second pull tabs 44, 45 causing both pull tabs 44, 45 to detach from at the end of each of the pull tabs 44, 45 and then along the line of reduced strength 42 around the corner of the lid 14. In each case, the corner of the lid 14 is completely detached from the container 10 to provide visual evidence of the opening of the container 10.

Alternatively, to ensure that the corner is only partially detached, two lines of reduced strength 42 can be provided that extend around the corner but do not intersect. Thus when the user pulls either the first or second pull tab 44, 45 and detaches the pull tab 44, 45 and the corner along only one of the lines of reduced strength 42, the remaining pull tab 44, 45, and consequently the corner, remains attached to the lid 14.

As further shown in FIGS. 9A and 9B, the lid 14 having first and second pull tabs 44, 45 can further include a gripping tab 48 as described above with reference to FIG. 9, to further facilitate opening of the container 10. The gripping tab 48 can be located adjacent to one or both of the first or second pull tabs 44, 45, outwardly extending from the portion of the outer wall 38 from which the pull tab 44, 45 extends. Of course, the gripping tab 48 may be disposed in similar locations on the lids 14 having only a single pull tab 44.

Figure 10A:
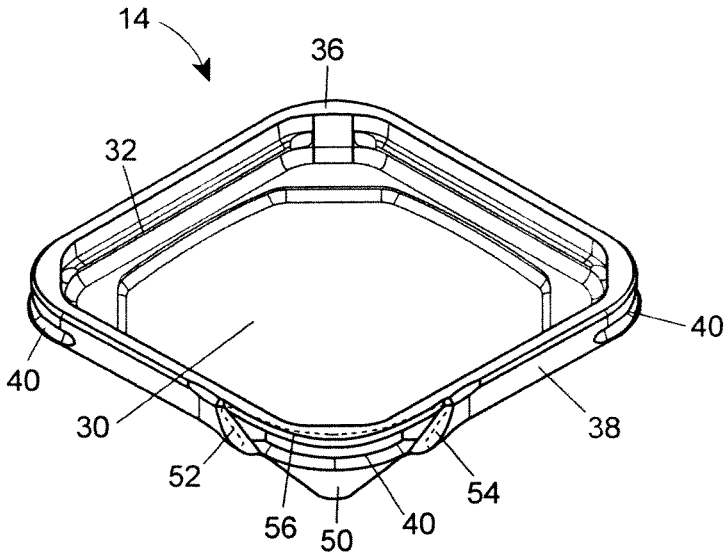
FIGS. 10A and 10B are perspective and top views of the lid of the tamper evident container of FIG. 1 having a pull tab disposed at the corner of the lid.
Figure 10B:
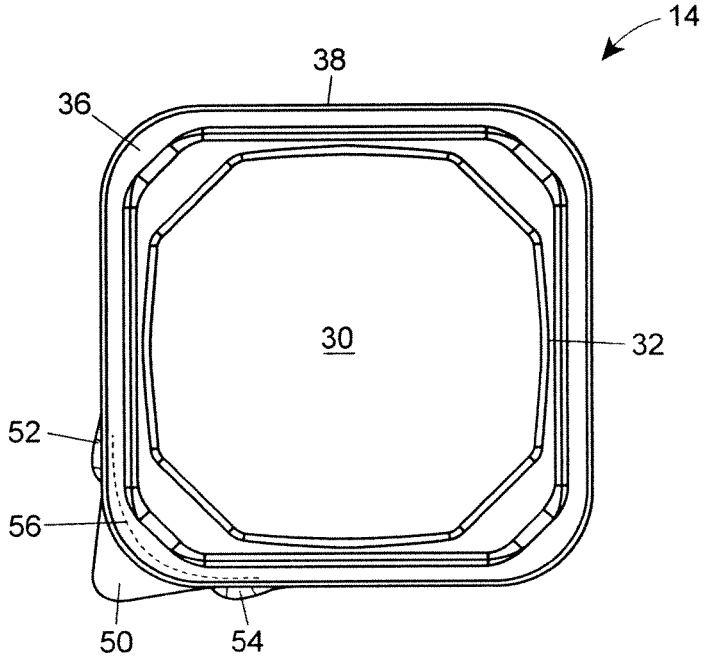

Referring to FIGS. 10A and 10B, in yet another embodiment, the lid 14 can include a pull tab 50 disposed at the corner of the lid 14 that may be partially detached and lifted outwardly and/or upwardly to disengage the indentation 40 located at the corner from the corresponding corner of the storage element 12. In the illustrated embodiment, two lines of reduced strength 52, 54 may be provided on opposite sides of the pull tab 50 and may extend along the outer wall 38 portions of the top wall 36. When the user grasps and pulls the pull tab 50 outward and upward, the lines of reduced strength 52, 54 may cause the pull tab 50 to detach along the lines of reduced strength 52, 54 to partially detach the corner of the lid 14. As the corner detaches and the pull tab 50 is pulled further away from the lid 14, the top wall 36 proximate the lines of reduced strength 52, 54 may plastically deform or detach such that the indentation 40 disengages from the flange 22 and the corner and the pull tab 50 remains disposed away from the side of the container 10 to provide visual evidence of the opening of the container 10. With one of the corners detached, the adjacent corners may be pulled outwardly away from the flange 22 and lifted over the flange 22 to remove the lid 14 from the storage element 12. If the corner is only partially detached, the corner may be pulled or pressed back down against the corresponding corner of the storage element 12. The indentation 40 disposed at the corner may reengage with the storage element 12 to reseal the container 10. A third line of reduced strength 56 may be provided along the corner, which may aid in preventing a user from using the pull tab 50 to disengage the indentation 40 without detaching the corner along the lines of reduced strength 52, 54. The third line of reduced strength 56 may be disposed on the top wall 36 of the lid 14 along the corner. The third line of reduced strength 56 may be connected to or may be an extension of one or both of the lines of reduced strength 52, 54. In the alternative, the third line of reduced strength 56 may be disposed on the pull tab 50 so that a portion of the pull tab 50 detaches along the third line of reduced strength 56, thereby preventing the pull tab 50 from providing leverage for disengaging the lid 14 without detaching the corner along the lines of reduced strength 52, 56.

As discussed above, other container 10 shapes are contemplated. For example, the container 10 may have a round opening, and a round lid 14 may be provided. In such a round configuration, the lid 14 may have a series of indentations 40 spaced around the outer wall 38 of the lid 14. Alternatively, the lid 14 may have a single indentation 40 around all of or substantially the entire outer wall 38. In either configuration, the indentation(s) 40 prevent the lid 14 from being removed from the storage element 12 without evidence of the removal.

The lid 14 also includes a line of reduced strength 42 and a pull tab 44 as discussed above. In the circular configuration, the line of reduced strength 42 may extend in the range of 30° to 120°, and in some embodiments in the range of 60° to 90° around the circumference of the top wall 36 of the lid 14 to ensure a sufficient amount of detachment of the indentation(s) 40 to allow the lid 14 to be removed from the storage element 12.

Figure 11A:
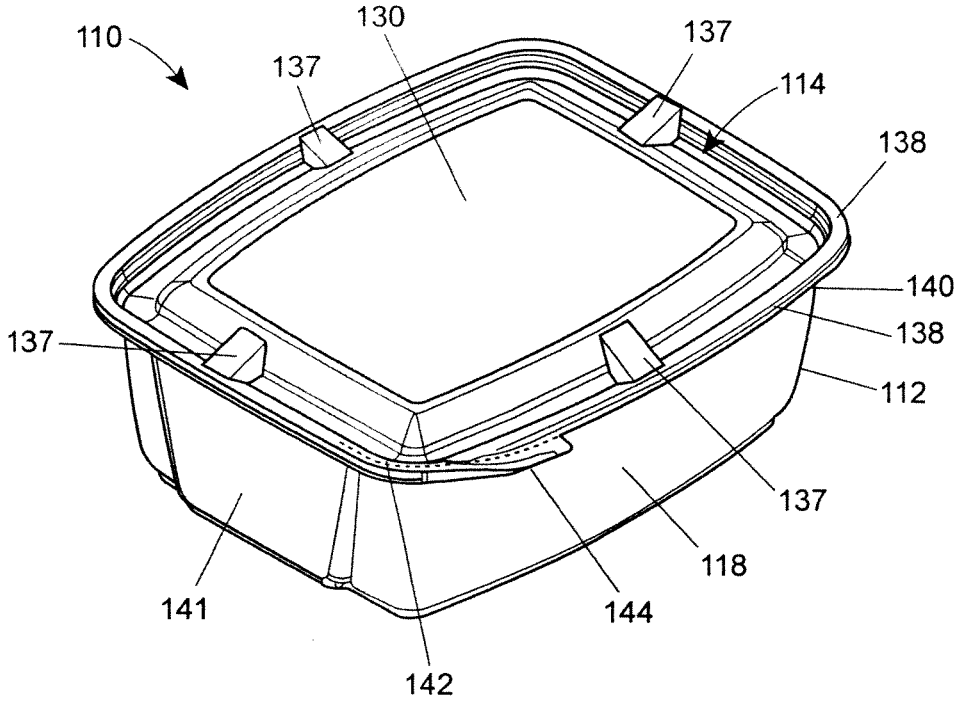
FIGS. 11A-11D are perspective, side, and detail views, respectively, of a tamper evident container in accordance with the present disclosure.
Figure 11B:
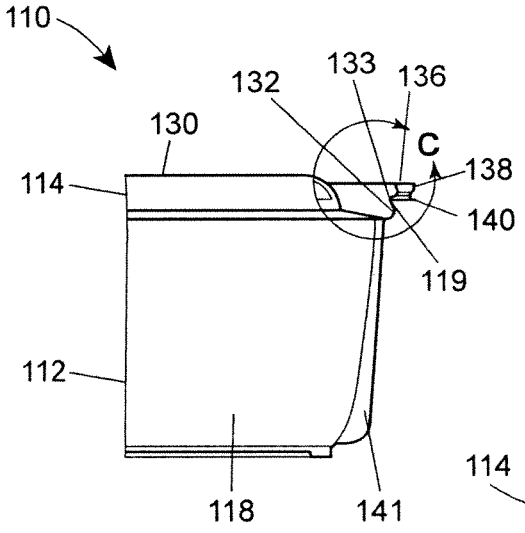
Figure 11C:
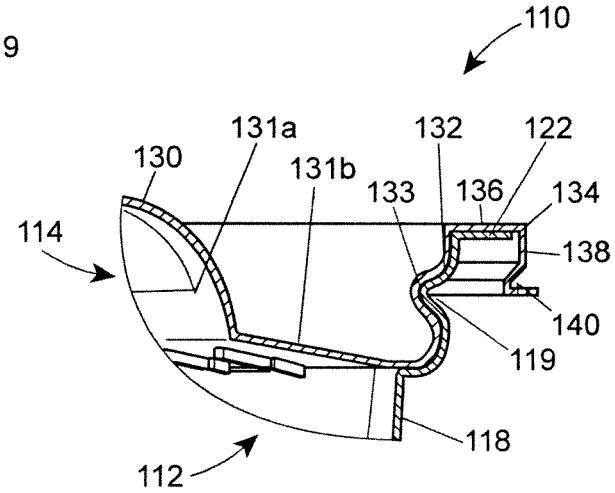

FIGS. 11A-11C illustrate an alternative embodiment of a tamper evident container 110 having a storage element 112 and a lid 114. For consistency, similar elements of the container 110 are identified herein by similar reference numerals as used above having a leading "1," and where appropriate redundant description of similar elements is omitted. The lid 114 may include an indentation 140 that may be formed continuously along the outer wall 138. Alternatively, the indentation 140 may be formed as described above, along only the corners of the lid 114. As described above, the indentation 140 extend inwardly at a negative angle $\phi$ so that the indentation 140 wrap inwardly underneath the flange 122 of the storage element 112, as is best illustrated in FIG. 11C. The indentation 140 functions as described above to secure the lid 114 on the storage element 112 so that the lid 114 cannot be removed in a manner that is not evident to an observer. The indentation 140 assists in ensuring that the lid 114 remains locked on the storage element 112 at the center portions of the sidewall 118 of the storage element 112. This may be advantageous in securing a lid 114 of a larger container having increased sidewall 118 lengths between the corners.

Figure 11D:
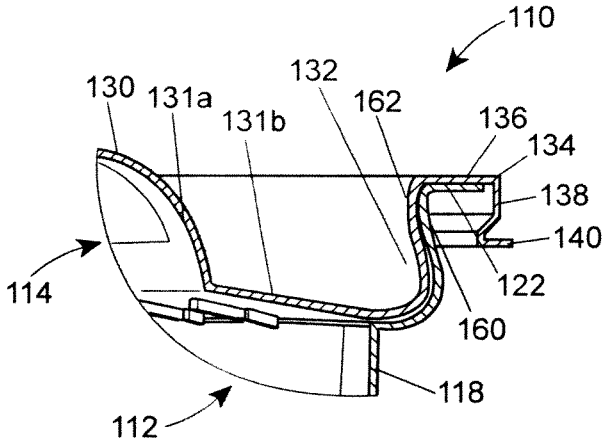

In the illustrated embodiment, an internal lock may be formed by the engagement of a ridge 119 of the storage element 112 and a slot 133 of the lid 114 in a similar manner as described above. Referring to FIG. 11D, in addition to or as an alternative to the indentation 140 and/or ridge 119 and slot 133 configurations, the lid 114 may be secured to the storage element 112 by an internal lock formed by a locking portion 160 of a side wall 118 of the storage element 112 and a locking portion 162 of the inner wall 132 of the lid 114. The locking portion 160 of a side wall 118 of the storage element 112 may be disposed adjacent the top edge 120 and angled outwardly from the center of the storage element 112 as it extends downwardly from the flange 122. The locking portion 162 of the inner wall 132 of the lid 114 may be disposed adjacent the upper edge 134 at a location corresponding to the locking portion 160 of the storage element 112, and may be angled outwardly from the center of the lid 114 as it extends downward from the top wall 136 at an angle corresponding to the angle of the locking portion 160 of the side wall 118 of the storage element 112. Configured in this way, the locking portion 162 of the inner wall 132 may be received and engaged by the locking portion 160 of the side wall 118 of the storage element 112 to retain the lid 114 on the storage element 112 such that the lid 114 cannot be removed from the storage element 112 without permanently deforming at least one of the lid 114 and the storage element 112 The top wall 136 of lid 114 may extend over the flange 122 of the storage element 112 to further prevent a user from disengaging the internal lock in a manner that is not evident to an observer.

As shown in FIG. 11A, one or more of the walls 132, 136, 138 can include one or more gussets 137 to improve the stability and rigidity of the lid 114, and further prevent the lid 114 from being removed without first detaching the pull tab 144 and corresponding corner along the line of reduced strength 142. The embodiment illustrated in FIGS. 11A-11C further illustrates the storage element 112 having one or more portions 141 disposed on and outwardly extending from an exterior portion of the side wall 118 in various locations. The portions 141 may provide a foot upon which the container 10 can be propped up on the portions and consequently a side of the container 110. The portions 141 may further improve the stiffness of the storage element 112 and aid in retaining the lid 114 on the storage element 112 by preventing the portions of the side walls 118 from buckling when forces are applied to the adjacent portions of the side wall 118, or from being forced inward in an attempt to reach under the top wall 136 of the lid 114 to disengage the lid 114 from the storage clement 112. When the portions of the side wall 118 having the curved portion 141 is forced inward, the curved portion 141 forces the flange 122 into tighter engagement with top and outer walls 136, 138 of the lid 114.

The lid 114 of the container 110 of FIGS. 11A-11C may also include a raised base wall 130 in contrast to the flat or lowered base wall 30 of lid 14. The raised base wall 130 may be used to increase the volume of the container 110 and the bottom of the storage element 112 may have a complimentary shape to promote stacking of the containers 110. A center portion of the raised base wall 130 may also be recessed to provide a surface for receiving the bottom of the storage element 112 to promote stacking of the containers 110. As best illustrated in FIG. 12C, the base wall 130 may include a raised portion 131*a* and a flange 131*b* that extends outwardly toward the inner wall 132. The flange 131*b* can be angled downwardly from a bottom edge of the raised portion 131*a* to the inner wall 132. When disposed at a downward angle, the flange 131*b* may further secure the lid 114 against the storage element 112. When a downward force is applied to the lid 114 in an attempt to open the container 110 by collapsing the lid 114, the flange 131*b* may flatten and extend toward the inner wall 132, thereby forcing the inner wall 132 of the lid 114 into tighter engagement against the side wall 118 of the storage element 112, and further securing the lid 114 on the storage element 112.

Figure 12:
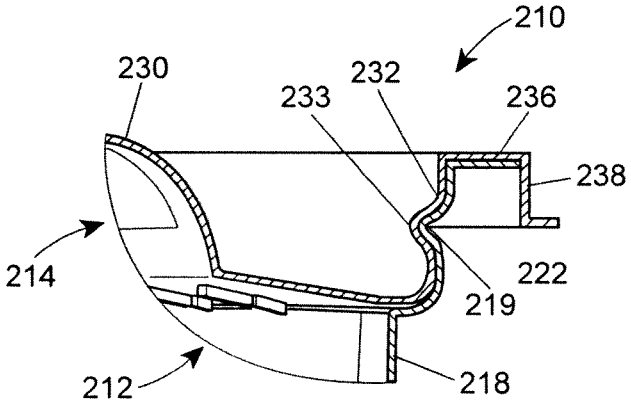
FIG. 12 is a cross-sectional view of a tamper evident container in accordance with the present disclosure.

FIG. 12 illustrates an alternative embodiment of a tamper evident container 210 having a storage element 212 and a lid 214. For consistency, similar elements of the container 210 are identified herein by similar reference numerals as used above having a leading "2", and where appropriate redundant description of similar elements is omitted. In the illustrated embodiment, an internal lock may be formed by the engagement of a ridge 219 of the storage element 212 and a slot 233 of the lid 214 in a similar manner as described above. The ridge 219 may extend along an internal surface of the side wall 218 of the storage element 212. The ridge 219 may projected inwardly from the side wall 218 to a width in a range of 0.01" to 0.2". The ridge 219 may have a substantially half-circle cross-sectional shape, a substantially rectangular cross-sectional shape, a substantially triangular cross-sectional shape, or other desired cross-sectional shapes. The inner slot 33 may be disposed along the inner wall 32. The inner slot 233 may have a depth corresponding to or slightly less than the width of the ridge 219 so as to provide a tight engagement between the inner slot 233 and the ridge 219. The inner slot 233 may also include a cross-sectional shape substantially corresponding to the cross-sectional shape of the ridge 219. Other configurations of the slot 233 and ridge 219 are contemplated. For example, the slot 233 may formed on the storage element 212, and the ridge 219 may be formed on the lid 214. The tight engagement between the inner slot 233 and ridge 219 may increase the rigidity of the container 210 when the lid 214 is retained on the storage element 214. Additionally, the other adjacent surfaces of the lid 214 and the storage element may tightly engage one another, such as the facing surfaces of the side wall 218 and the inner wall 232, and the adjacent surfaces of the outer wall 238 and the outer edge of the glance 222. The tight engagement may enhance the locking of the lid on the tray and increase the rigidity of the container 210. The container 210 may further include an indentation formed as described above, which may further ensure that the lid 214 remains locked on the storage element 214.

When the lid 214 is attached to the storage element 212, the ridge 219 may deflect outwardly and/or the slot 233 may deflect inwardly to allow the ridge 219 to be received in and engaged by the slot 233. Once the ridge 219 is received in the slot 233, the resiliency of the material(s) from which the storage element 212 and the lid 214 are fabricated allow the components to return their normal geometries to lock the lid 214 onto the storage element 212. The outwardly extending top wall 236 and downwardly extending outer wall 238 of the lid 214 may extend over the flange 222 of the storage element 212, which may prevent a user from reaching under the lid and pulling on the flange 222 to separate the flange 222 from the top wall 236 and disengage the ridge 219 from the slot 233 to open the container in a manner not evident to an observer. The downwardly extending outer wall 238 may further include an outwardly extending portion disposed at a bottom edge of the outer wall 238.

The container 210 may further include a line of reduced strength 242, such as a line of punctures, score lines, a continuous line of reduced thickness, a blade scoring line having punctures and bridges adjacent the punctures, and combinations thereof. The line of reduced strength 242 can be formed as described above and can extend along a portion of the top and outer walls 236, 238 at one of the corners, along one of the sides, or a combination thereof, to allow for detachment of the portion, and thereby allow a user to reach under the lid and access the flange 222 to disengage the ridge 219 from the slot 233 and, consequently, the lid 214 from the storage element 214.

As described above, to facilitate detachment of a portion of the top and outer walls 236, 238 along the line of reduced strength 242, the lid 214 may include a pull tab 244 attached to a portion of the outer wall 238 of the lid 214 proximate the portion of the outer wall and/or top wall having the line of reduced strength 242. When the user grasps and pulls the pull tab 244 outwardly from the container 210, the punctures, score lines, or the like cause the pull tab 244 to detach at the end of the pull tab 244 and then along the line of reduced strength 242 along the top and/or outer wall 236, 238. Detachment of a portion of the top and/or outer wall 236, 238 may then allow a user reach under the top wall 236 of the lid 214 to disengage the ridge 219 of the storage element 212 from the slot 233 of the lid 214, and thereby detach the lid 214 from the storage element 212. The detachment of the portion of the top and/or outer wall 236, 238 may also allow the user access to a portion of the storage element 212 which may be grasped and provide leverage for disengaging the lid 214 from the storage element 212.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A tamper evident container for storing a quantity of a product, comprising:

a storage element having a top edge defining an opening of the storage element and having a flange extending outwardly therefrom; and a lid having a complimentary shape to the opening of the storage element and including a top wall and an outer wall defining configured to fit over the flange of the storage element with the outer wall extending below a bottom edge of the flange, the outer wall including at least one inwardly extending locking indentation engaging the bottom edge of the flange of the storage element when the lid is disposed on the storage element to retain the lid on the storage element such that the lid cannot be removed from the storage element without permanently deforming at least the storage element, the lid further including a pull tab and a line of reduced strength extending along a portion of the top wall and along the pull tab proximate the outer wall to detach a portion of the outer wall and disengage the corresponding portion of the at least one locking indentation from the flange to allow the lid to be disengaged from the flange without further permanent deformation of at least the storage element, the pull tab includes a surface having an end proximate the top wall and an opposing end proximate the bottom edge of the outer wall, the surface extending downwardly from the end to the opposing end at an angle in the range of 5° to 30° such that the pull tab may be grasped and pulled away from the lid to separate both the pull tab and the outer wall from the lid along the line of reduced strength.

2. The tamper evident container of claim 1, wherein the opening of the storage element is substantially rectangular and includes four corners, wherein the lid has a corresponding rectangular shape and the outer wall of the lid has four locking indentations each disposed at one of the corners and engaging the bottom edge of the flange at the corresponding corner, and wherein the line of reduced strength extends along the top wall around one of the corners such that the corresponding locking indentation disengages from the flange when the portion of the outer wall is separated from the lid along the line of reduced strength.

3. The tamper evident container of claim 1, wherein the opening of the storage element is a shape selected from the group consisting of a round shape, an oval shape, a rectangular shape, and a rounded rectangular shape, and wherein the lid has a corresponding shape.

4. The tamper evident container of claim 1, wherein the line of reduced strength extends circumferentially along the top wall of the lid to substantially define an arc in the range of 30° to 120° along the top wall when opening of the storage element and the lid have a round shape.

5. The tamper evident container of claim 3, wherein the lid comprises one locking indentation extending substantially the entire length of the outer wall.

6. The tamper evident container of claim 1, wherein the surface of the tab extends downwardly from the top wall at an approximate angle of 17°.

7. The tamper evident container of claim 1, wherein the lid further comprises a second pull tab extending outwardly from the outer wall and disposed opposite the pull tab, with the line of reduced strength extending along the second pull tab such that the second pull tab may be grasped and pulled away from the lid to separate the second pull tab and outer wall from the lid along the line of reduced strength.

8. The tamper evident container of claim 1, wherein the storage element further includes a side wall extending downwardly from the top edge with a portion of the side wall adjacent the top edge angled outwardly away from a center of the storage element as the portion extends downwardly from the top edge, and the lid further includes an inner wall extending downwardly from the top wall with a portion of the inner wall adjacent the top wall being angled outwardly away from a center of the lid as the portion extends downwardly from the top wall such that the angled portion of the inner wall engages the angled portion of the side wall of the storage element to retain the lid on the storage element.

9. The tamper evident container of claim 1, wherein the storage element further includes a side wall extending downwardly from the top edge and a ridge extending along the side wall, and the lid further includes an inner wall extending downwardly from the top wall and a slot extending along the inner wall and sized to receive and engage the ridge to retain the lid on the storage element.

10. The tamper evident container of claim 1, wherein the at least one locking indentation extends inwardly at approximately a 45° negative angle.

11. The tamper evident container of claim 1, wherein the line of reduced strength comprises one or more of a line of punctures, a score line, a line of reduced thickness, and a blade scoring line having punctures and bridges adjacent the puncture.

12. A lid for a container for storing a quantity of a product and having a storage element having a top edge defining an opening of the storage element and a flange extending outwardly therefrom, the lid comprising:

a pull tab;

a base wall having a complimentary shape to the opening of the storage element;

an outer wall extending downwardly from the base wall, wherein the base wall and the outer wall are configured to fit over the flange of the storage element with the outer wall extending below a bottom edge of the flange, and wherein the outer wall includes at least one inwardly extending locking indentation engaging the bottom edge of the flange of the storage element when the lid is disposed on the storage element to retain the lid on the storage element such that the lid cannot be removed from the storage element without permanently deforming the storage element;

and a line of reduced strength extending along a portion of the base wall and the pull tab proximate the outer wall to detach a portion of the outer wall and disengage the corresponding portion of the at least one locking indentation from the flange to allow the lid to be disengaged from the flange without further permanent deformation of at least the storage element, the pull tab includes a surface having an end proximate the base wall and an opposing end proximate the bottom edge of the outer wall, the surface extending downwardly from the end to the opposing end at an angle in the range of 5° to 30° such that the pull tab may be grasped and pulled away from the lid to separate both the pull tab and outer wall from the lid along the line of reduced strength.

13. The lid of claim 12, wherein the opening of the storage element is rectangular and includes four corners, wherein the lid has a corresponding rectangular shape and the outer wall of the lid has four locking indentations each disposed at one of the corners and engaging the bottom edge of the flange at the corresponding corner, and wherein the line of reduced strength extends along the top wall around one of the corners such that the corresponding locking indentation disengages from the flange when the portion of the outer wall is separated from the lid along the line of reduced strength.

14. The lid of claim 12, wherein the opening of the storage element is a shape selected from the group consisting of a round shape, an oval shape, a rectangular shape, and a rounded rectangular shape, and wherein the lid has a corresponding shape.

15. The lid of claim 14, wherein the line of reduced strength extends circumferentially along the base wall of the lid to define substantially an arc in the range of 30° to 120° along the top wall.

16. The lid of claim 14, wherein the lid comprises one locking indentation extending substantially the entire length of the outer wall.

17. The lid of claim 12, wherein the surface of the tab extends downwardly at an approximate angle of 17°.

18. The lid of claim 12, further comprises a second pull tab extending outwardly from the outer wall and disposed opposite the pull tab, with the line of reduced strength extending along the second pull tab proximate the outer wall such that the second pull tab may be grasped and pulled away from the lid to separate the second pull tab and outer wall from the lid along the line of reduced strength.

19. The lid of claim 12, wherein the at least one locking indentation extends inwardly at approximately a 45° negative angle.

20. The lid of claim 12, wherein the line of reduced strength comprises one or more of a line of punctures, a score line, a line of reduced thickness, and a blade scoring line having punctures and bridges adjacent the puncture.

21. The lid of claim 12, wherein the base wall comprises a side wall extending upwardly from the base wall and having a top edge with a complimentary shape to the opening of the storage element, and a top wall extending outwardly from the side wall at the top edge, a portion of the side wall adjacent the top edge angled outwardly away a center of the lid as the portion extends downwardly from the top wall such that the angled portion of the side wall of the lid corresponds to and engages a portion of a side wall of the storage element angled outwardly away from a center of the storage element as the portion extends downwardly from the top edge of the storage element to retain the lid on the storage element.

22. The lid of claim 12, wherein the base wall comprises a side wall extending upwardly from the base wall and having a top edge with a complimentary shape to the opening of the storage element, a top wall extending outwardly from the side wall at the top edge, and a ridge extending along the side wall, the ridge receiving and engaging a slot extending along a side wall of the storage element that downwardly extends from the top edge of the storage element to retain the lid on the storage element.

23. A lid for storing a quantity of a product and having a storage element having a top edge defining an opening of the storage element and a flange extending outwardly therefrom, the lid comprising:

a base wall;

a side wall extending upwardly from the base wall and having a top edge with a complimentary shape to the opening of the storage element;

a top wall extending outwardly from the side wall at the top edge; an outer wall, wherein the side wall, the top wall and the outer wall are configured to fit over the flange of the storage element with the outer wall extending below a bottom edge of the flange, the outer wall including at least one inwardly extending locking indentation engaging the bottom edge of the flange of the storage element when the lid is disposed on the storage element to retain the lid on the storage element such that the lid cannot be removed from the storage element without permanently deforming at least the storage element;

a pull tab disposed adjacent a corner of the outer wall and outwardly extending from the outer wall, the pull tab comprises a surface having an end proximate the top wall and an opposing end proximate the bottom edge of the outer wall, the surface extending downwardly 5° from the end to the opposing end at an angle in the range of 5° to 30° such that the pull tab may be grasped and pulled away from the lid to separate both the pull tab and outer wall from the lid along the line of reduced strength; and two lines of reduced strength each extending along a portion of the top wall to detach the corner of the outer wall and disengage the corresponding portion of the at least one locking indentation from the flange to allow the lid to be disengaged from the flange without further permanent deformation of at least the storage element.

24. The lid of claim 23, wherein the opening of the storage element is rectangular and includes four corners, wherein the lid has a corresponding rectangular shape and the outer wall of the lid has four locking indentations each disposed at one of the corners and engaging the bottom edge of the flange at the corresponding corner, and wherein the lines of reduced strength extends along the top wall adjacent opposite sides of one of the corners such that the corresponding locking indentation disengages from the flange when the portion of the outer wall is separated from the lid along the lines of reduced strength.

25. The lid of claim 23, wherein the surface of the tab extends downwardly at an approximate angle of 17°.

26. The lid of claim 23, wherein the at least one locking indentation extends inwardly at approximately a 45° negative angle.

27. The lid of claim 23, wherein the lines of reduced strength each comprise one or more of a line of punctures, a score line, a line of reduced thickness, and a blade scoring line having punctures and bridges adjacent the puncture.

28. The lid of claim 23, wherein a portion of the side wall adjacent the top edge is angled outwardly away from a center of the lid as the portion extends downwardly from the top edge such that the angled portion of the side wall of the lid corresponds to and engages a portion of a side wall of the storage element angled outwardly away from a center of the storage element as the portion extends downwardly from the top edge of the storage element to retain the lid on the storage element.

29. The lid of claim 23, wherein the side wall includes a ridge extending along the side wall, the ridge receiving and engaging a slot extending along a side wall of the storage element that downwardly extends from the top edge of the storage element to retain the lid on the storage element.

30. A tamper evident container for storing a quantity of a product, comprising:

a storage element having a top edge defining an opening of the storage element and having a flange extending outwardly therefrom, and a side wall downwardly extending from the top edge, the sidewall including an inwardly extending ridge formed on the sidewall; and a lid having a complimentary shape to the opening of the storage element and including a top wall and an outer wall configured to fit over the flange of the storage element with the outer wall extending below a bottom edge of the flange, the lid further including an inner wall downwardly extending from the top wall, the inner wall including a slot configured to receive and engage the ridge of the storage element when the lid is disposed on the storage element to retain the lid on the storage element such that the lid cannot be removed from the storage element without permanently deforming at least the storage element, the lid further including a pull tab and a line of reduced strength extending along a portion of the top wall along the pull tab proximate the outer wall to detach a portion of the outer wall and allow a user to access a corresponding portion of the flange to separate the flange from the top wall and disengage a portion of the ridge from the slot to allow the lid to be disengaged from the storage element without further permanent deformation of at least the storage element, the pull tab includes a surface having an end proximate the top wall and an opposing end proximate the bottom edge of the outer wall, the surface extending downwardly from the end to the opposing end at an angle in the range of 5° to 30° such that the pull tab may be grasped and pulled away from the lid to separate both the pull tab and outer wall from the lid along the line of reduced strength.

31. The tamper evident container of claim 30, wherein the opening of the storage element is a shape selected from the group consisting of a round shape, an oval shape, a rectangular shape, and a rounded rectangular shape, and wherein the lid has a corresponding shape.

32. The tamper evident container of claim 30, wherein the surface of the tab extends downwardly at an approximate angle of 17°.

33. The tamper evident container of claim 30, wherein the lid further comprises a second pull tab extending outwardly from the outer wall and disposed opposite the pull tab, with the line of reduced strength extending along the second pull tab such that the second pull tab may be grasped and pulled away from the lid to separate the second pull tab and outer wall from the lid along the line of reduced strength.

34. The tamper evident container of claim 30, wherein the line of reduced strength comprises one or more of a line of punctures, a score line, a line of reduced thickness, and a blade scoring line having punctures and bridges adjacent the puncture.

35. The tamper evident container of claim 30, wherein the ridge has a cross-sectional shape selected from the group consisting of round, rectangular, and triangular, and the slot has a corresponding shape.

36. The tamper evident container of claim 30, wherein the slot extends outwardly from the side wall 18 of the storage element to a width in a range of 0.01" to 0.2", and the lid has a corresponding width.

* * * * *